US010967648B2

(12) United States Patent
Kakui et al.

(10) Patent No.: US 10,967,648 B2
(45) Date of Patent: Apr. 6, 2021

(54) PRINTER

(71) Applicant: SATO HOLDINGS KABUSHIKI KAISHA, Tokyo (JP)

(72) Inventors: Yasuyuki Kakui, Saitama (JP); Hirohito Shimazaki, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/607,427

(22) PCT Filed: Sep. 25, 2018

(86) PCT No.: PCT/JP2018/035516
§ 371 (c)(1),
(2) Date: Oct. 23, 2019

(87) PCT Pub. No.: WO2019/167321
PCT Pub. Date: Sep. 6, 2019

(65) Prior Publication Data

US 2020/0130364 A1 Apr. 30, 2020

(30) Foreign Application Priority Data

Feb. 28, 2018 (JP) ..... JP2018-034817

(51) Int. Cl.
*B41J 2/32* (2006.01)
*B41J 25/304* (2006.01)

(52) U.S. Cl.
CPC ..... *B41J 2/32* (2013.01); *B41J 25/304* (2013.01); *B41J 2202/30* (2013.01)

(58) Field of Classification Search
CPC ..... B41J 2/32; B41J 25/304; B41J 2202/30; B41J 2202/31; B41J 2/325; B41J 25/34
(Continued)

(56) References Cited

U.S. PATENT DOCUMENTS 5,366,302 A * 11/1994 Masumura ..... B41J 25/316 347/197
5,565,905 A * 10/1996 Kajiya ..... B41J 13/10 347/197
(Continued)

FOREIGN PATENT DOCUMENTS

EP 0 765 761 A1 4/1997
EP 1 914 083 A1 4/2008
(Continued)

OTHER PUBLICATIONS

U.S. Appl. No. 29/638,654, filed Feb. 28, 2018, Kazuyuki Hoshi et al.
(Continued)

*Primary Examiner* — Huan H Tran
*Assistant Examiner* — Alexander D Shenderov
(74) *Attorney, Agent, or Firm* — Foley & Lardner LLP

(57) ABSTRACT

A printer includes a thermal head that performs printing on a print medium, a head unit to which the thermal head is attached, a holding part movable between a first position for holding the thermal head at an attachment position of the head unit and a second position for canceling the holding of the thermal head to the attachment position, and a receiving part that receives the thermal head when the holding part is at the second position.

8 Claims, 9 Drawing Sheets

(58) Field of Classification Search
USPC ..... 347/371
See application file for complete search history.

(56) References Cited

U.S. PATENT DOCUMENTS

| | | | | |
|---|---|---|---|---|
| D375,975 | S | 11/1996 | Koizumi et al. | |
| 5,694,159 | A | 12/1997 | Kajiya et al. | |
| 5,779,371 | A * | 7/1998 | Aoyama | B41J 25/34 347/197 |
| D410,949 | S | 6/1999 | Fowkes | |
| 6,307,580 | B1 | 10/2001 | Yoshikawa | |
| D542,344 | S | 5/2007 | Duby et al. | |
| 7,399,130 | B2 | 7/2008 | Hirte et al. | |
| 8,068,127 | B2 | 11/2011 | Ochiai et al. | |
| D652,446 | S | 1/2012 | Brady et al. | |
| D653,284 | S | 1/2012 | Amidon et al. | |
| D689,439 | S | 9/2013 | Yu et al. | |
| 8,564,633 | B2 | 10/2013 | Matsushima et al. | |
| 8,610,752 | B2 | 12/2013 | Tsugaru | |
| 9,662,900 | B1 | 5/2017 | Liu et al. | |
| D849,690 | S | 5/2019 | Luo | |
| D859,317 | S | 9/2019 | Huang et al. | |
| D873,341 | S | 1/2020 | Horikawa et al. | |
| D901,390 | S | 11/2020 | Ma et al. | |
| 2001/0005216 | A1 | 6/2001 | Takahashi et al. | |
| 2002/0033874 | A1 | 3/2002 | Aubin et al. | |
| 2002/0048479 | A1 | 4/2002 | Bryant et al. | |
| 2003/0146968 | A1 | 8/2003 | Milton | |
| 2008/0094463 | A1* | 4/2008 | Tsuchida | B41J 2/32 347/197 |
| 2011/0193926 | A1 | 8/2011 | Matsushima et al. | |
| 2011/0193927 | A1 | 8/2011 | Matsushima et al. | |
| 2012/0212562 | A1* | 8/2012 | Tsugaru | B41J 29/13 347/222 |
| 2016/0347093 | A1 | 12/2016 | Ogasawara et al. | |
| 2018/0186155 | A1 | 7/2018 | Hoshi | |
| 2019/0039393 | A1 | 2/2019 | Hoshi | |
| 2019/0070874 | A1 | 3/2019 | Hoshi | |
| 2019/0126636 | A1 | 5/2019 | Hoshi | |
| 2019/0126645 | A1 | 5/2019 | Hoshi | |
| 2019/0299679 | A1 | 10/2019 | Ushiama | |

FOREIGN PATENT DOCUMENTS

| | | | |
|---|---|---|---|
| EP | 2 641 745 | A1 | 9/2013 |
| JP | 57-088131 | U | 5/1982 |
| JP | 07-081179 | A | 3/1995 |
| JP | 07-256977 | | 10/1995 |
| JP | 2989024 | B2 | 12/1999 |
| JP | 2003-220722 | A | 8/2003 |
| JP | 2006-334952 | A | 12/2006 |
| JP | 2006-334953 | A | 12/2006 |
| JP | 2007-136931 | A | 6/2007 |
| JP | 2012-171114 | A | 9/2012 |
| JP | 2014-133364 | A | 7/2014 |
| WO | WO-2018/051767 | A1 | 3/2018 |
| WO | WO-2018/051769 | A1 | 3/2018 |
| WO | WO-2018/051770 | A1 | 3/2018 |
| WO | WO-2018/051771 | A1 | 3/2018 |

OTHER PUBLICATIONS

U.S. Appl. No. 29/659,475, filed Aug. 9, 2018, Yasuhide et al.
European Search Report, Application No. 17850671.3, dated Jul. 30, 2019, 11 pages.
European Search Report, Application No. 17850673.9, dated Jul. 9, 2019, 8 pages.
European Search Report, Application No. 17850674.7, dated Jul. 30, 2019, 8 pages.
European Search Report, Application No. 17850675.4, dated Jul. 16, 2019, 9 pages.
Google translation of JP 2007-136931, published on Jun. 2007, 5 pages.
Human English Translation of JP 2006-334952, 39 pages.
Machine-generated translation of JP 2006-334952, published on Dec. 2006, 17 pages.
USPTO Notice of Allowance, U.S. Appl. No. 15/759,061, dated Jan. 24, 2019, 15 pages.
USPTO Notice of Allowance, U.S. Appl. No. 15/759,061, dated Nov. 13, 2019, 13 pages.
USPTO Notice of Allowance, U.S. Appl. No. 15/759,331 dated Jan. 31, 2019, 13 pages.
USPTO Notice of Allowance, U.S. Appl. No. 15/759,331, dated May 8, 2019, 21 pages.
USPTO Notice of Allowance, U.S. Appl. No. 15/759,337, dated Jul. 15, 2019 9 pages.
USPTO Notice of Allowance, U.S. Appl. No. 15/759,383 dated Dec. 3, 2019, 9 pages.
USPTO Office Action, U.S. Appl. No. 15/759,061, dated May 7, 2019, 14 pages.
USPTO Office Action, U.S. Appl. No. 15/759,337, dated Apr. 10, 2019, 11 pages.
USPTO Office Action, U.S. Appl. No. 15/759,383, dated Jul. 23, 2019, 12 pages.
USPTO Office Action, U.S. Appl. No. 15/759,383, dated Apr. 12, 2019, 12 pages.
USPTO Office Action, U.S. Appl. No. 15/907,890, dated Aug. 7, 2019, 16 pages.
European Office Action, Application No. 17 850 671.3, dated Mar. 18, 2020, 6 pages.
European Office Action, Application No. 17 850 674.7, dated Mar. 18, 2020, 5 pages.
Chinese Office Action, Application No. 201780045890.X, dated Jan. 2, 2020, 7 pages.
Chinese Office Action, Application No. 201780045900.X, dated Jan. 2, 2020, 7 pages.
Chinese Office Action, Application No. 201780045904.8, dated Dec. 26, 2019, 6 pages.
Google translation of JP 2006-334953, published on Dec. 2006. (Year: 2006).
Notice of Allowance, U.S. Appl. No. 15/759,061, dated Jan. 15, 2020, 12 pages.
USPTO Office Action, U.S. Appl. No. 15/759,383, dated Jan. 13, 2020, 6 pages.
Chinese Office Action and English translation, Application No. 201780055650.8, dated Mar. 3, 2020, 13 pages.
USPTO Restriction Office Action, U.S. Appl. No. 29/659,475, dated Feb. 20, 2020, 14 pages.
Notice of Allowance, U.S. Appl. No. 15/759,383, dated May 5, 2020, 9 pages.
USPTO Notice of Allowance, U.S. Appl. No. 29/659,475, dated Oct. 20, 2020, 7 pages.
IBM aCard IDE to LVD-SCSi Bridge Adapter, posted 2010, retrieved Jun. 20, 2020 from https://www.amazon.com/aCard-LVD-SCSi-Bridge-Adapter-AEC-7722/dp/B00BNHQ3BE/ref=V4ASHR022K3H&dchild=1&keyword=.
USPTO Office Action, U.S. Appl. No. 29/659,475, dated Jun. 25, 2020, 10 pages.
Japanese Office Action and English Translation, Application No. 2018-539603, dated Oct. 27, 2020, 10 pages.
Japanese Office Action and English Translation, Application No. 2018-539605, dated Nov. 4, 2020, 6 pages.
Japanese Office Action and English Translation, Application No. 2018-539606, dated Oct. 20, 2020, 6 pages.
Japanese Office Action and English Translation, Application No. 2018-539607, dated Nov. 4, 2020, 4 pages.
Notice of Allowance, U.S. Appl. No. 15/907,890, dated Aug. 11, 2020, 14 pages.
USPTO Office Action, U.S. Appl. No. 29/638,654, dated Aug. 6, 2020, (now US 2018/0186155, US 20020163204, U.S. Pat. No. D. 621,060, U.S. Pat. No. D. 280,109, U.S. Pat. No. D. 846,955, U.S. Pat. No. D. 434,909, U.S. Pat. No. D. 433,237, U.S. Pat. No. D. 875,056, U.S. Pat. No. D. 843,334, U.S. Pat. No. D. 798,822, U.S. Pat. No. D. 757,666, U.S. Pat. No. D. 753,073, U.S. Pat. No. D. 733,056, U.S. Pat. No. D. 465,772, How to install a PCI or PCI-Express expansion card, by lowendguru, dated Aug. 5, 2014,

(56) References Cited

OTHER PUBLICATIONS youtube.com [online]. Retrieved Aug. 2, 2020 from internet (Year: 2014), <URL:https://www.youtube.com/watch?time_continue=22&v=p9pTv1 S5gsw&feature=emb_logo>, HP300312A-G02 16pins SHEC C56 Thermal Head for Taico Printer, dated Dec. 16, 2017, printhead-barcode.com [online]. Retrieved Aug. 2, 2020 from internet <URL:http://www.printhead-barcode.com/index.php?main_page=product_info&products_id=2965> (Year: 2017)).
Kyocera Avery Monarch KPA-104-8TAW1-MM1 Thermal Label Printer Print Head, posted NA [online], (retrieved Feb. 4, 2021). Retrieved from the internet, https://www.ebay.com/c/1451731436?iid=313285433051 (Year: NA), 4 pages.
USPTO Notice of Allowance, U.S. Appl No. 29/731,950, filed Feb. 18, 2021, 33 pages.
USPTO Office Action, U.S. Appl. No. 29/638,654, filed Feb. 9, 2021, 11 pages.
Extended European Search Report Issued in European Patent Application No. 18907605.2 dated Feb. 25, 2021, 7 pages.

* cited by examiner

PRINTER

TECHNICAL FIELD

The present invention relates to a printer including a thermal head that performs printing.

BACKGROUND ART

JP2014-133364A discloses a printer that includes a thermal head that performs printing on a print medium, a head base to which the thermal head is attached, and a head holder that holds the thermal head at the head base.

The head holder is made of an elastic member. When the thermal head is exchanged, a manual operation of holding and elastically deforming the head holder and attaching the thermal head to the head base is performed.

SUMMARY OF INVENTION

However, generally users may not be used to exchanging the thermal head. The operation of exchanging the thermal head without dropping the thermal head from the head base may be difficult for such users.

In view of this, an object of the present invention is to provide a printer in which a thermal head can be easily exchanged.

An aspect of the present invention provides a printer includes a thermal head configured to print on a print medium, a head unit to which the thermal head is attached, a hold part movable between a first position for holding the thermal head at an attachment position of the head unit and a second position for canceling the holding of the thermal head to the attachment position, and a receive part configured to receive the thermal head when the hold part is at the second position.

According to the above-described aspect, when the thermal head is exchanged, the operator moves the hold part to the second position, so that the holding of the thermal head is released. Then, the thermal head is received by the receiving part, to be prevented from falling and hitting with other parts. Thus, the thermal head needs not to be manually received by the operator, and thus can be easily exchanged.

DESCRIPTION OF EMBODIMENTS

Hereinafter, a printer 100 according to an embodiment of the present invention will be described below with reference to the drawings.

Figure 1:
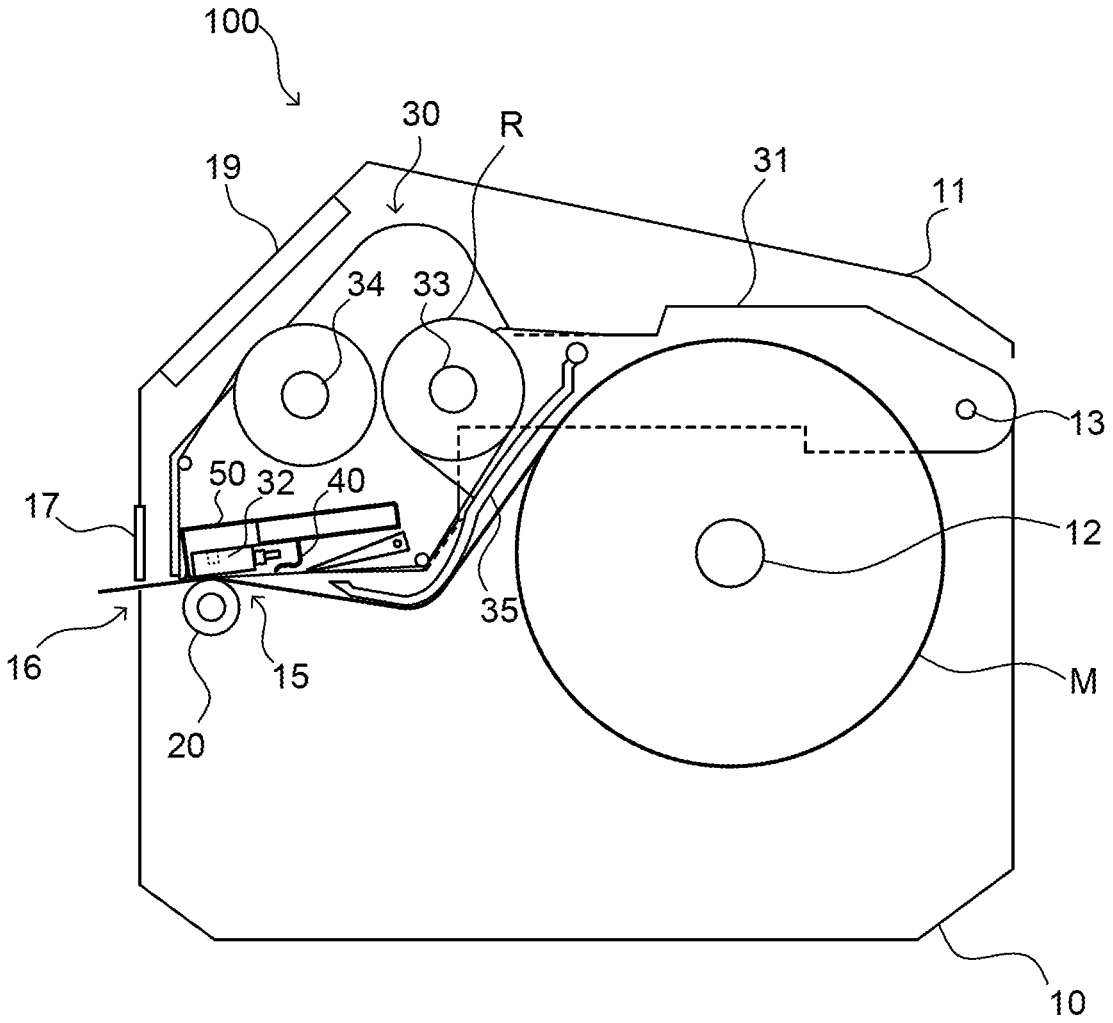
FIG. 1 is a schematic view illustrating a configuration of a printer according to an embodiment of the present invention.

As illustrated in FIG. 1, the printer 100 is a thermal transfer printer 100 in which an ink ribbon R is heated and inks of the ink ribbon R are transferred to a print medium M, so that printing is performed. The print medium M is, for example, a continuous label body in which plural labels are continuously temporarily attached at a predetermined interval to a band-shaped liner sheet. While the thermal transfer printer is described herein, a thermosensitive printer requiring no ink ribbon may be used instead.

The printer 100 includes a casing 10 and a cover 11 that covers an opening portion of the casing 10.

The cover 11 has an end portion on one end side is supported by the support shaft 13 so the cover is swingable. By swinging with the support shaft 13 as a supporting point, it is possible to switch the cover 11 between an open state where the opening of the casing 10 is opened (see FIG. 2) and a closed state where the opening portion is closed (see FIG. 1).

The print medium M is rolled to be in a rolled form to be caught by a medium supply shaft 12. The print medium M may also be a linerless label, or a fanfold type medium.

Between an other-end side end portion of the cover 11 and the casing 10, an outlet port 16 that discharges the print medium M to which printing is already performed by a printing portion 15 from the printer 100 is formed.

A cutter 17 facing the outlet port 16 is attached to the cover 11. Thereby, it is possible to cut the printed print medium M discharged from the outlet port 16. Various units can be attached to the printer 100, examples of which include a peeling unit that peels a strip-shaped liner from a label and a cutter unit that cuts a linerless label (strip-shaped linerless label).

An operation unit 19 for operating the printer 100 is also provided in the cover 11.

Inside the printer 100, a printing unit 30 for performing printing to the print medium M, a controller (not shown) that controls an operation of the printer 100, and the like.

The printing unit 30 includes a frame 31 with one end pivotally supported by the support shaft 13, a head unit 50 provided to the frame 31, and a thermal head 32 attached to the head unit 50.

The thermal head 32 constitutes the printing portion 15 that performs printing to the print medium M together with a platen roller 20 provided to the casing 10 side.

The printing unit 30 can be pivot between a printing position (see FIG. 1) with which the print medium M is nipped between the thermal head 32 and the platen roller 20 and a non-printing position (see FIGS. 2 and 3) with which the thermal head 32 is separated from the platen roller 20.

The printing unit 30 also includes a ribbon supply shaft 33 that holds the ink ribbon R, in a rolled form, to be supplied to the printing portion 15, a ribbon roll up shaft 34 that rolls up a used the ink ribbon R, and a partition member 35 that partitions the ink ribbon R and the print medium M. The partition member 35 is pivotally supported by the frame 31. The ribbon supply shaft 33 is detachably attached to the partition member 35. The ribbon supply shaft 33 is rotationally driven by the platen driving roller via a gear (not shown).

The print medium M is supplied from the print medium M in a rolled form caught by the medium supply shaft 12 to the printing portion 15, and is nipped between the thermal head 32 and the platen roller 20 together with the ink ribbon R.

The printing unit 30 prints to the print medium M with the ink ribbon R nipped between the thermal head 32 and the platen roller 20. In other words, when electricity is distributed through to a heating element of the thermal head 32 in as state where the print medium M and the ink ribbon R are nipped between the thermal head 32 and the platen roller 20, the inks of the ink ribbon R are transferred to the print medium M by heat of the heating element, so the printing is performed to the print medium M.

When the platen roller 20 is rotated forward by a platen drive motor (not shown), the print medium M and the ink ribbon R are fed to the downstream side in the feed direction, and the print medium M is discharged to the outside of the printer 100 through the outlet port 16.

Figure 3:
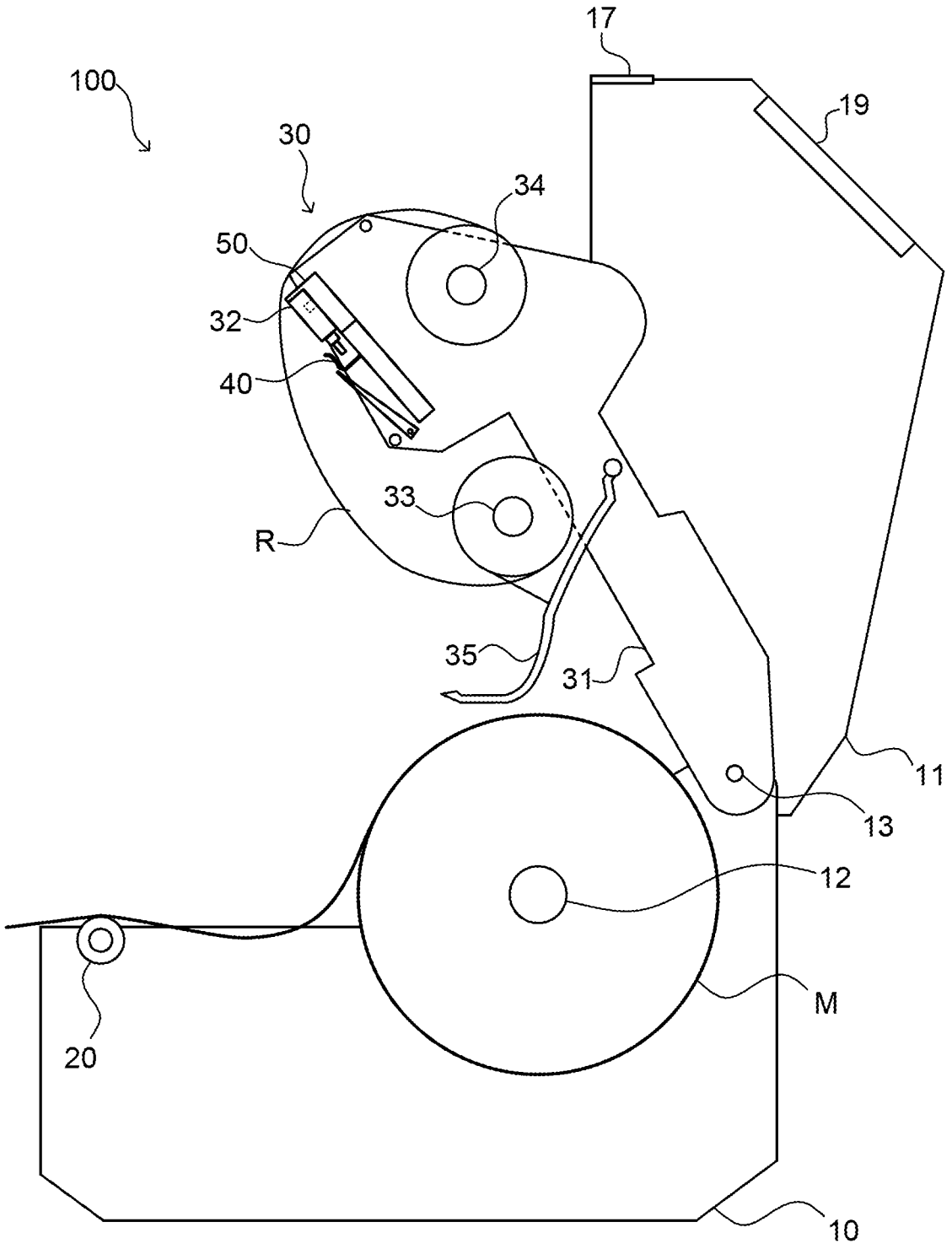
FIG. 3 is a diagram illustrating a state where a ribbon supplying shaft is at a ribbon exchange position.

When the printer 100 performs printing, the cover 11 is in the closed state as illustrated in FIG. 1. When the cover 11 transitions to the open state from the closed state, the opening of the casing 10 is open with the printing unit 30 integrally pivoted while being accommodated in the cover 11 to be in an upright posture. Then, when the partitioning member 35 pivots toward the casing 10 with respect to the cover 11, the partitioning member 35 and the cover 11 are disengaged from each other (an unillustrated mechanism for engaging with the cover 11 is provided near a rotation shaft of the partitioning member 35). Thus, the opening position of the printing unit 30 and the partitioning member 35 is achieved as illustrated in FIG. 3.

In this process, the printing unit 30 is in an inclined posture to be inclined toward the casing 10 while being exposed to the outside of the cover 11. The ink ribbon R in a rolled form caught by the ribbon supplying shaft 33 moves relative to the ribbon roll up shaft 34 and is exposed to the side of the outlet port 16 of the print medium M.

This results in the ribbon supply shaft 33 being at the exchanging position to be detachable from the printer 100, whereby the operation of exchanging the ink ribbon R can be performed. As described above, with the exchanging position, the operation of exchanging the thermal head 32 can be performed in a state where the ink ribbon R and the like have been removed.

Next, a configuration for detachably attaching the thermal head 32 will be described with reference to FIG. 4 to FIG. 5C.

The following description is given with three axes (X, Y, and Z) set to be orthogonal to each other in the drawings. The X axis direction in which the thermal head 32 is attached/detached will be referred to as an attaching/detaching direction. The Y axis direction in which a connector 55 that holds the thermal head 32 moves as described later will be referred to as a holding direction. The Z axis direction will be referred to as a longitudinal direction.

The printer 100 includes a head unit 50 to which the thermal head 32 is attached. The head unit 50 is fixed to the frame 31 of the printing unit 30.

The head unit 50 is provided as an accommodation unit that accommodates parts to which the thermal head 32 is attached. The parts include a support part 51, protruding parts 52, receiving parts 40, and the like.

The supporting part 51 includes a planer portion that extends in the holding direction and the longitudinal direction. The thermal head 32 is supported by the head unit 50 with its back surface 32B (see FIG. 5A) coming into contact with the supporting part 51.

The protruding parts 52 are each formed to have a form of a cylinder protruding in the attaching/detaching direction from the supporting part 51. The thermal head 32 has recesses 32C in a form of a circular hole that fits with the respective protruding parts 52.

With the recesses 32C slidably fit, the protruding parts 52 enable the movement of the thermal head 32 in the attaching/detaching direction while restricting the movement of the protruding parts 52 in directions other than the attaching/detaching direction, which are the holding direction and the longitudinal direction, and thus serve as restriction parts for positioning the thermal head 32 with respect to the supporting part 51. In an actual configuration, the protruding parts 52 and the recesses 32C are fit to each other with a clearance in between, and thus the thermal head 32 is movable in the direction other than the attaching/detaching direction, which are the holding direction and the longitudinal direction, within a range defined by the clearance.

Note that the configuration described above should not be construed in a limiting sense, and protruding parts may be formed to protrude from the back surface 32B of the thermal head 32, and recesses that fit with the protruding parts may be formed as the restriction parts on the head unit 50.

The two protruding parts 52 are arranged in the longitudinal direction of the thermal head 32 while being separated from each other by a sufficient distance.

Note that the configuration described above should not be construed in a limiting sense, and a single protruding part with a sufficient length may extend in the longitudinal direction of the thermal head 32. Furthermore, three or more protruding parts may be arranged in the longitudinal direction of the thermal head 32 while being separated from each other by a sufficient distance.

When the thermal head 32 is exchanged, the printing unit 30 is inclined toward the casing 10, while being exposed to the outside of the cover 11 as illustrated in FIG. 3, and thus the attaching/detaching direction (X axis) is inclined relative to a horizontal line L. Thus, simple fitting of the recesses 32C with the protruding parts 52 might result in the thermal head 32 detaching from the protruding parts 52 and falling down.

In view of this, the receiving parts 40 are provided as illustrated in FIG. 5 to receive the thermal head 32 that has detached from the protruding parts 52 and falling down, when the thermal head 32 is exchanged.

Figure 4:
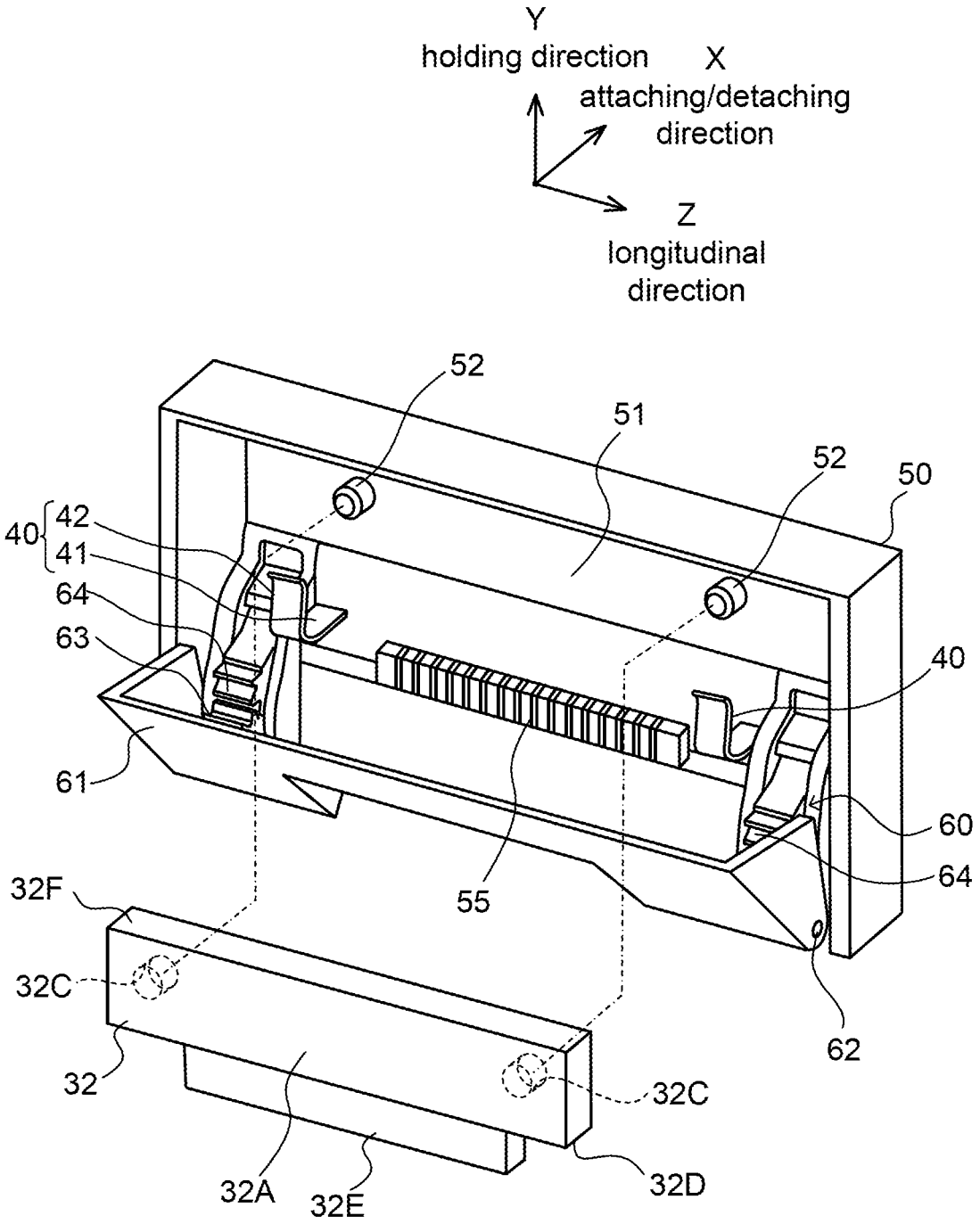
FIG. 4 is a perspective view of a thermal head and a head unit.
Figure 5A:
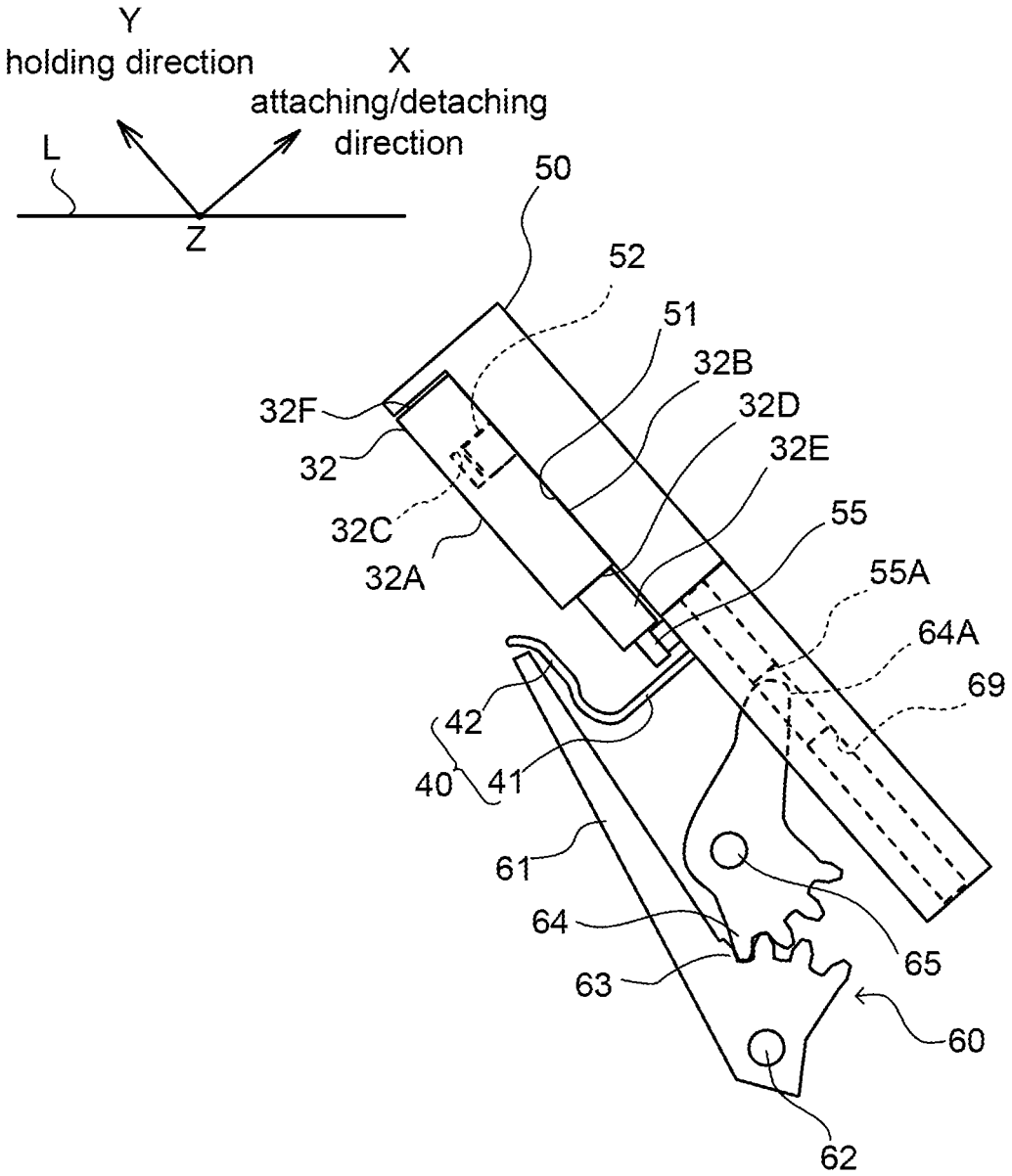
FIG. 5A is a cross-sectional view illustrating a state where the thermal head is attached.
Figure 5B:
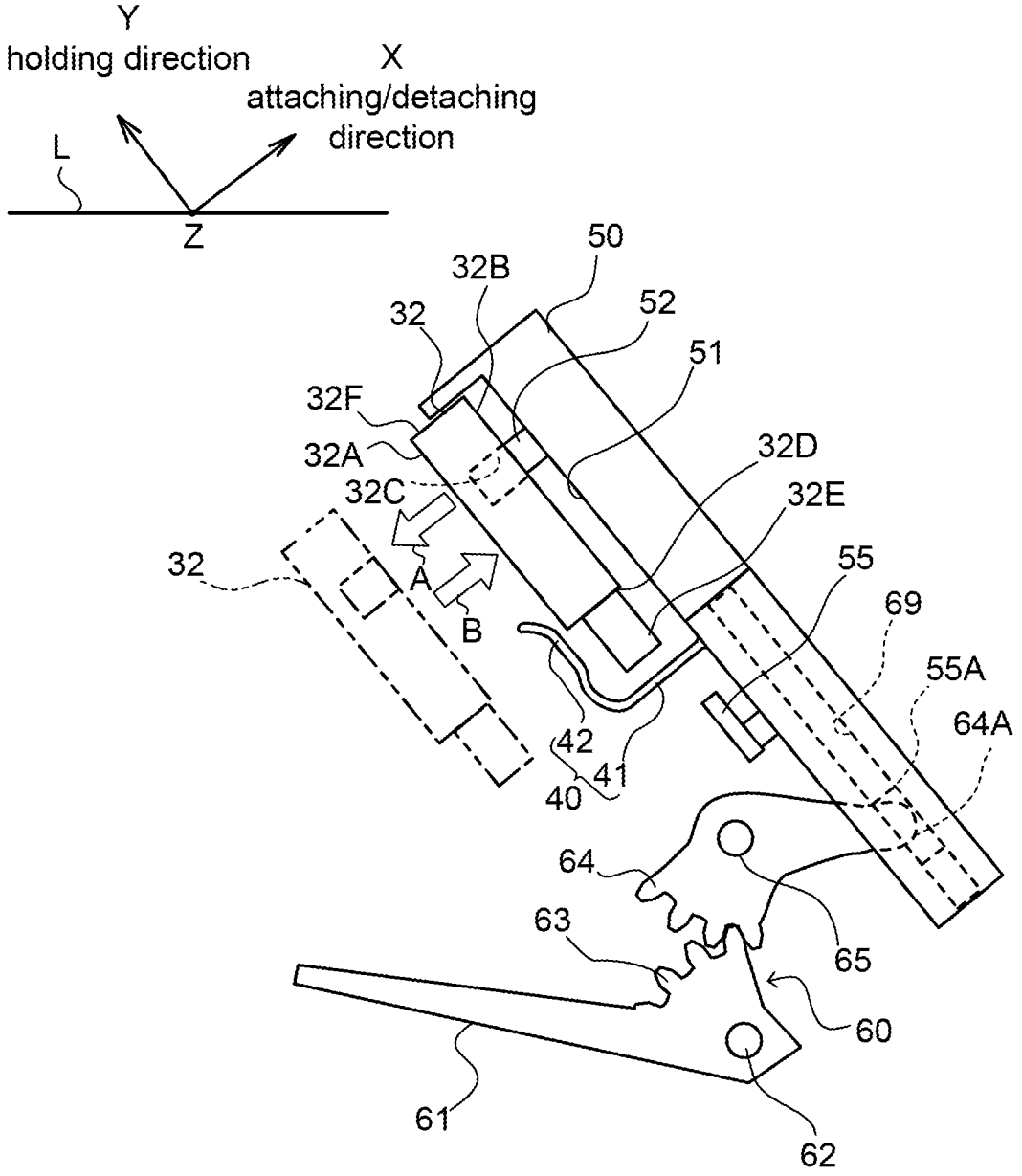
FIG. 5B is a cross-sectional view illustrating an operation of exchanging the thermal head.
Figure 5C:
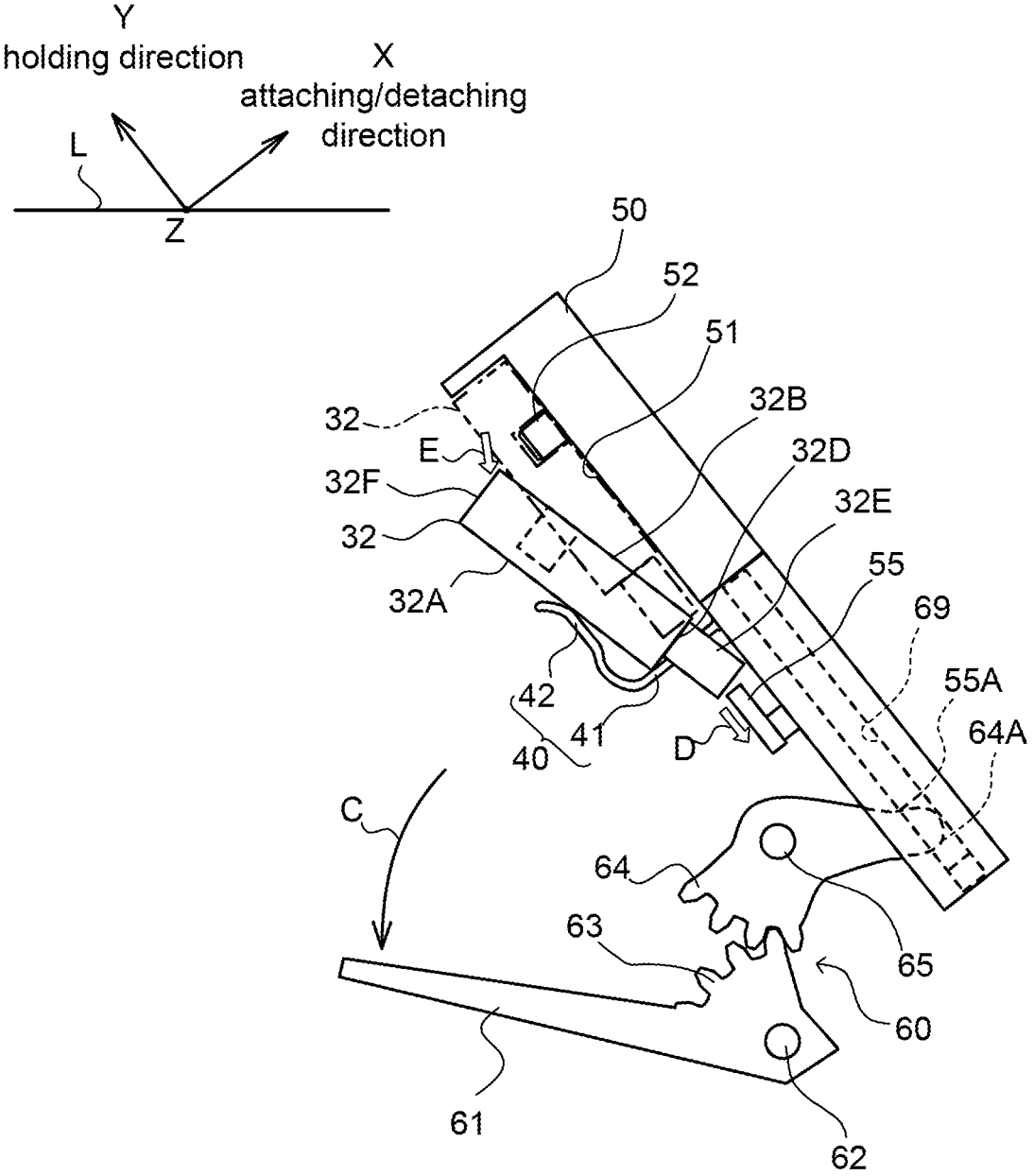
FIG. 5C is a cross-sectional view illustrating an operation of removing the thermal head.

As illustrated in FIG. 4 to FIG. 5C, in the head unit 50 at a position for exchanging the thermal head 32, the receiving parts 40 are provided below the supporting part 51 and the protruding parts 52.

The receiving parts 40 in a form of the letter L each include a first contact part 41 that is substantially orthogonal to the supporting part 51 and a second contact part 42 that is bent from the first contact part 41 and extends substantially in parallel with the supporting part 51.

As illustrated in FIG. 5C, in a state where the thermal head 32 is received by the receiving parts 40, a lower end 32D of the thermal head 32 is in contact with the first contact parts 41 and a front surface 32A of the thermal head 32 is in contact with the second contact parts 42. In this state, the thermal head 32 is inclined to have an upper end 32F separated from the supporting part 51 of the head unit 50. The thermal head 32 may be received by the receiving parts 40 in another pattern where the lower end 32D of the thermal head 32 does not come into contact with the first contact parts 41, the lower end of a connection part 32E of the thermal head 32 is in contact with the supporting part 51, and the front surface 32A of the thermal head 32 is in contact with the second contact parts 42 (not illustrated).

The two receiving parts 40 are arranged in the longitudinal direction of the thermal head 32 while being separated from each other by a sufficient distance. The connection part 32E of the thermal head 32 is provided between the two receiving parts 40.

Note that the configuration described above should not be construed in a limiting sense. A single receiving part with a sufficient length may extend in the longitudinal direction of the thermal head 32.

The printer 100 includes a connector 55 connected to the thermal head 32. The connector 55 serves as a holding part that holds the thermal head 32 at an attachment position.

The thermal head 32 includes the connection part 32E into which the connector 55 is inserted, so that a heating element is energized through the connector 55.

The thermal head 32 includes the back surface 32B supported by the supporting part 51, and the front surface 32A extending on the side opposite to the back surface 32B. The thermal head 32 heats the ink ribbon R on the side of the front surface 32A, so that ink on the ink ribbon R is transferred onto the print medium M, so that the print medium M is printed.

The connection part 32E is provided at the lower end 32D of the thermal head 32 at the exchange position. The connection part 32E has a shape with a portion receiving the connector 55 dented to be in a recessed form. However, this should not be construed in a limiting sense, and the connection part 32E may have a shape with a portion receiving the connector 55 bulging to be in a protruding form.

The printer 100 has a shielding member 61 that shields a part of the thermal head 32. The shielding member 61 has an end portion on one end side rotatably supported by a supporting shaft 62 provided to the head unit 50. The shielding member 61 can be pivoted about the supporting shaft 62, to be switched between an opening position (see FIGS. 5B and 5C) for opening the front surface 32A of the thermal head 32 and a shielding position (see FIG. 5A) for shielding a part of the front surface 32A of the thermal head 32.

The printer 100 includes interlocking mechanisms 60 that convert an opening/closing motion of the shielding member 61 into a motion of the connector 55 moving in the holding direction. The interlocking mechanisms 60 cause the connector 55 to move between a first position (see FIG. 5A) to be connected to the thermal head 32 and a second position (see FIGS. 5B and 5C) disconnected from the thermal head 32.

The interlocking mechanisms 60 each include a rail part 69 with which the connector 55 is supported to be movable in the holding direction, a gear 63 provided to the shielding member 61, and a gear 64 that meshes with the gear 63.

The connector 55 is provided with a slider 55A supported by the rail part 69 to be movable in the holding direction.

A set of the rail part 69, the slider 55A, and the interlocking mechanism 60 is provided to each of both end portions of the shielding member 61 in the longitudinal direction.

The gear 64 is rotatably supported by a supporting shaft 65 provided to the head unit 50. The gear 64 includes a cam 64A that engages with the slider 55A. The cam 64A rotates about the supporting shaft 65, so that the connector 55 moves in the holding direction.

Next, an operation performed when the thermal head 32 is exchanged will be described.

Figure 2:
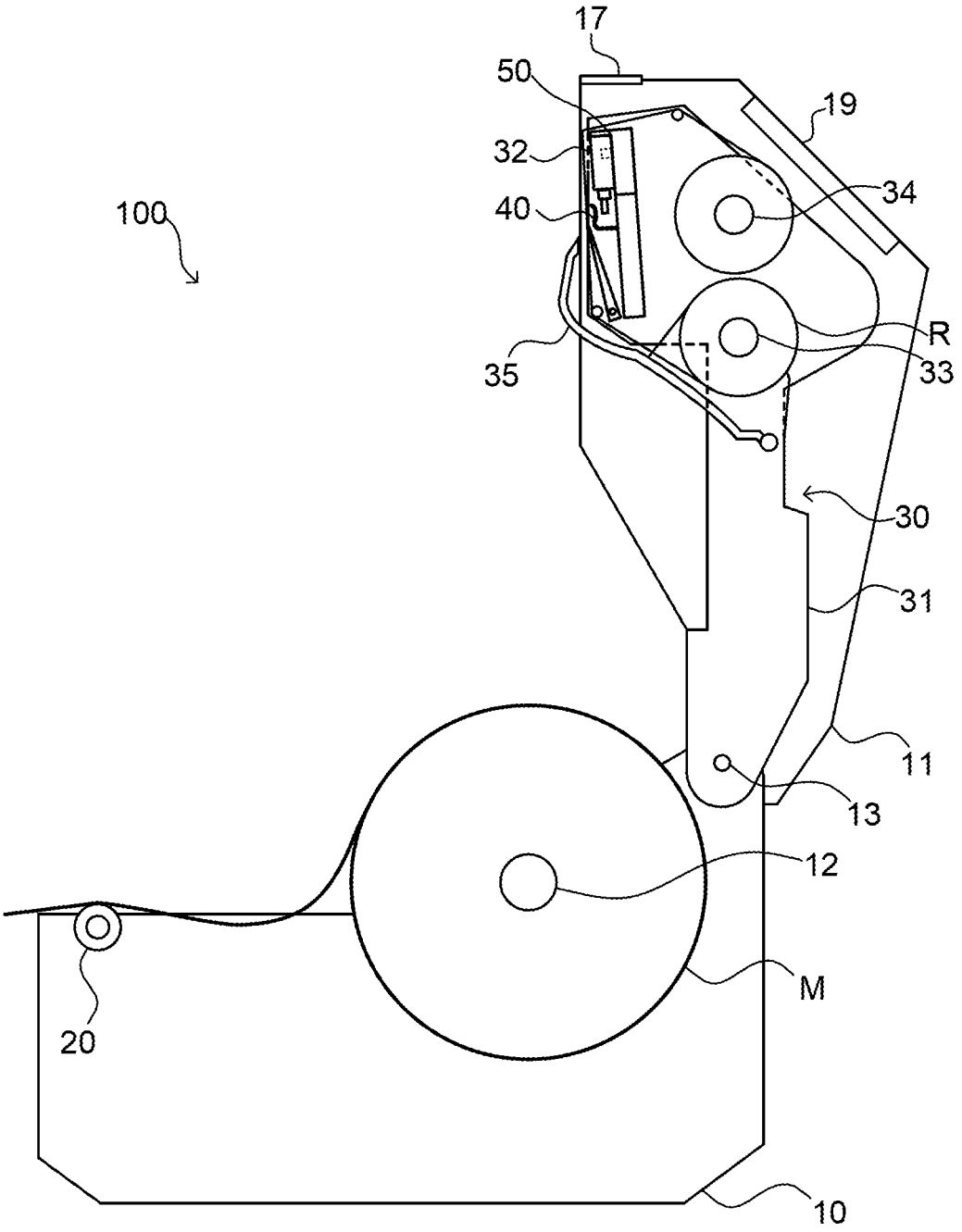
FIG. 2 is a diagram illustrating a state where a cover is open.

When the thermal head 32 is exchanged, an operator pivots the cover 11 in a closed state (see FIG. 1) to be in an open state (see FIG. 2). Then, the operator pivots the partitioning member 35 toward the casing 10, so that the position of the printing unit 30 is switched to the exchanging position at which the printing unit 30 is exposed to the outside of the cover 11 as illustrated in FIG. 3. Then, the operator removes the ink ribbon R and the like, and performs the exchanging operation for the thermal head 32.

As illustrated in FIG. 5A, when the shielding member 61 is at the shielding position, the thermal head 32 is held at a predetermined attachment position by the supporting part 51, the protruding parts 52, and the connector 55.

When the thermal head 32 is removed from the head unit 50, as illustrated in FIG. 5B, the operator pivots and opens the shielding member 61, and lowers and moves the connector 55 to the second position, whereby an open state is achieved.

In this state, the protruding parts 52 of the head unit 50 are inclined relative to the horizontal line. Thus, the gravity moves the thermal head 32 toward the side opposite to the head unit 50 in the attaching/detaching direction as indicated by an arrow A in FIG. 5B. Then, the recesses 32C of the thermal head 32 are detached from the protruding parts 52, and thus the operator needs not to perform a manual operation in which the thermal head 32 is held and removed from the protruding parts 52. Note that this should not be construed in a limiting sense, and the thermal head 32 may be removed from the head unit 50 with the protruding parts 52 of the head unit 50 extending in the horizontal direction. With this configuration, the operator needs to perform a manual operation in which the thermal head 32 is held and moved.

When the operator pivots and opens the shielding member 61, the connector 55 is lowered as indicated by an arrow D in FIG. 5C to be pulled out from the connection part 32E of the thermal head 32. Thus, the gravity moves the thermal head 32 toward the side opposite to the head unit 50 in the attaching/detaching direction. As a result, the thermal head 32 is detached from the protruding parts 52 to fall as indicated by an arrow E.

The receiving parts 40 receive the head unit 50 of the thermal head 32 thus falling.

As illustrated in FIG. 5C, in the state where the thermal head 32 is received by the receiving parts 40, the lower end 32D of the thermal head 32 is in contact with the first contact parts 41 and the front surface 32A of the thermal head 32 is in contact with the second contact parts 42. As described above, the thermal head 32 may be received by the receiving parts 40 in another pattern in which the lower end 32D of the thermal head 32 is not in contact with the first contact parts 41, the lower end of the connection part 32E of the thermal head 32 is in contact with the supporting part 51, and the front surface 32A of the thermal head 32 is in contact with the second contact parts 42 (not illustrated). As a result, the thermal head 32 is inclined to have its upper end 32F separated from the supporting part 51 of the head unit 50. In this state, the operator performs a manual operation of holding and taking out the thermal head 32, received by the receiving parts 40, from the head unit 50. In this manner, the operation of taking out the thermal head 32 from the head unit 50 is smoothly performed.

On the other hand, when the thermal head 32 is attached to the head unit 50, the operator moves the thermal head 32 toward the head unit 50 in the attaching/detaching direction as indicated by an arrow B in FIG. 5B. As a result, the thermal head 32 is held at the predetermined attachment position, with the recesses 32C fit with the protruding parts 52. Then, when the operator pivots and closes the shielding member 61, the connector 55 moves upward to be switched to the first position. At the first position, the connector 55 is inserted in the connection part 32E of the thermal head 32, to hold the thermal head 32 at the attachment position. In this manner, the thermal head 32 is smoothly attached to the head unit 50.

Figure 6A:
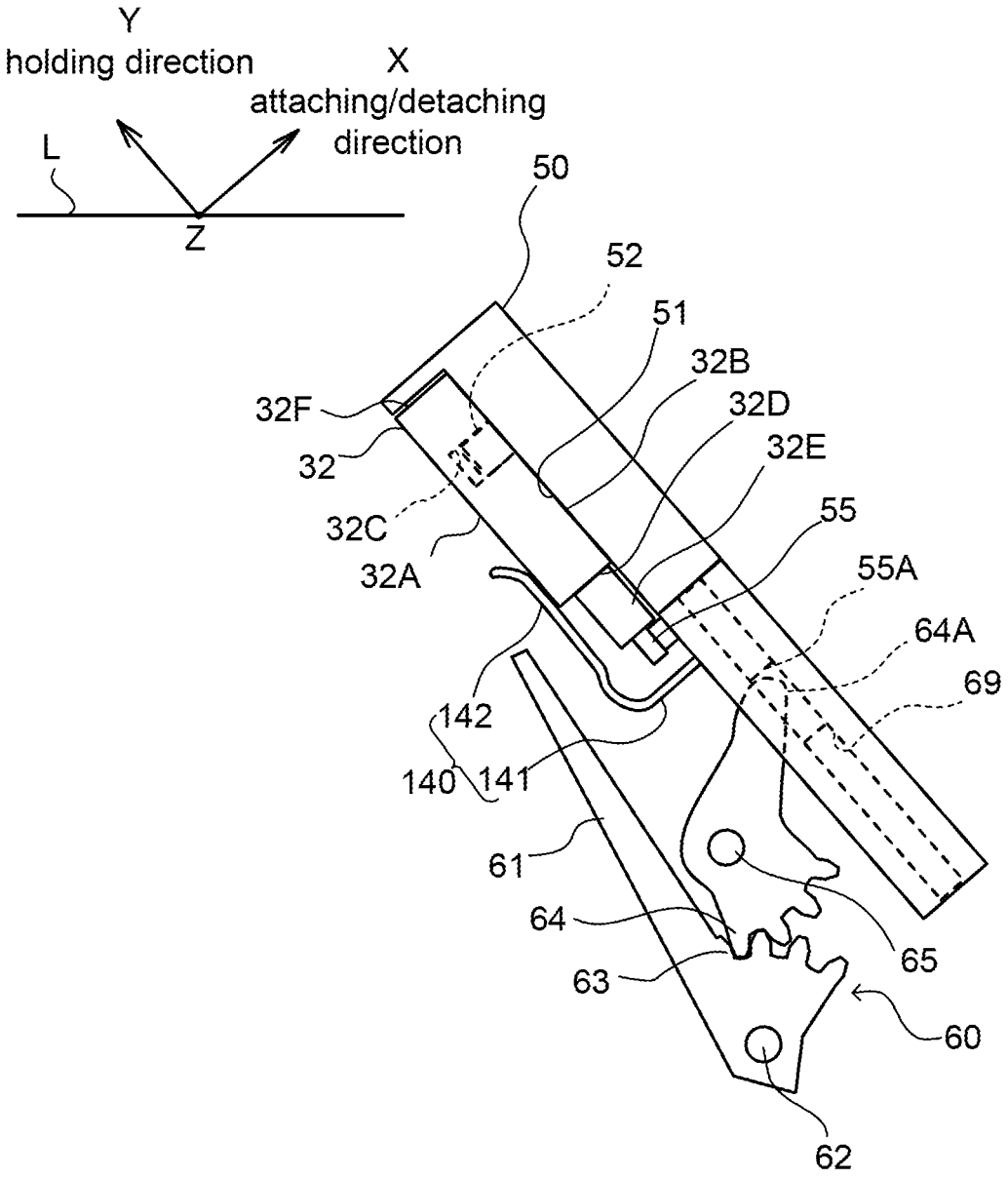
FIG. 6A is a cross-sectional view illustrating a modification of the thermal head and the head unit.
Figure 6B:
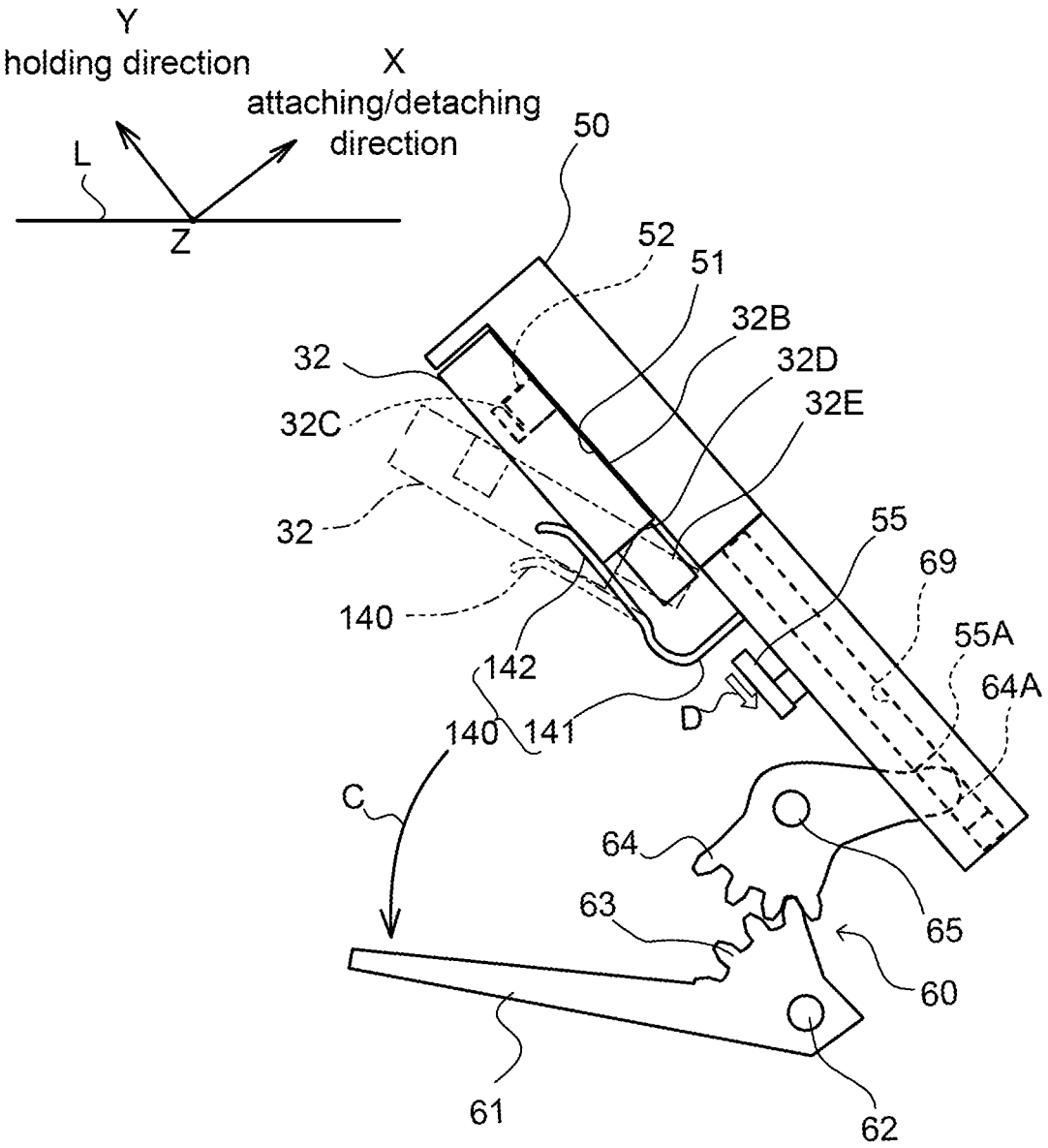
FIG. 6B is a cross-sectional view illustrating a modification of an operation of exchanging the thermal head.

FIG. 6A and FIG. 6B are cross-sectional views of a thermal head and a head unit according to a modification of the present embodiment. This modification features a receiving part 140 with a configuration different from that of the receiving parts 40 described above.

As illustrated in FIG. 6A, the receiving part 140 is disposed below the supporting part 51 and the protruding parts 52 in the head unit 50, as in the configuration illustrated in FIGS. 5A to 5C described above.

The receiving part 140 includes a first contact part 141 protruding to be substantially orthogonal to the supporting part 51 and a second contact part 142 that is bent upward from the first contact part 141 and extends substantially in parallel with the supporting part 51, to be in a form of the letter L.

The second contact part 142 of the receiving part 140 is formed to be in contact with the front surface 32A of the thermal head 32 in the state where the thermal head 32 is attached. The thermal head 32 is received by the second contact part 142 of the receiving part 140 while being fixed to the supporting part 51.

When the thermal head 32 is removed from the head unit 50, as illustrated in FIG. 6B, the operator pivots and opens the shielding member 61 and lowers the connector 55 to be moved to the second position, so that the open state is achieved. In this state, with the configuration described above, the thermal head 32 is received on the side of the head unit 50, with the receiving part 140 fixing the thermal head 32 to the supporting part 51 of the head unit 50. Thus, the thermal head 32 is prevented from falling.

The receiving part 140 is made of elastic resin or metal. Thus, the second contact part 142 of the receiving part 140 can be displaced relative to the supporting part 51 of the head unit 50.

When the thermal head 32 is removed, the thermal head 32 is inclined to have the upper end 32F separated from the supporting part 51 of the head unit 50. In this process, the second contact part 142 of the receiving part 140 elastically deforms toward the side away from the supporting part 51 of the head unit 50, as indicated by a double dash dotted line in FIG. 6B. As a result, the recesses 32C of the thermal head 32 are detached from the protruding parts 52, whereby the thermal head 32 can be easily removed from the head unit 50.

When the thermal head 32 is attached, the thermal head 32 is inserted between the second contact part 142 of the receiving part 140 and the supporting part 51 of the head unit 50. In this process, the second contact part 142 of the receiving part 140 elastically deforms toward the side away from the supporting part 51, as indicated by a double dash dotted line in FIG. 6B. As a result, the distance between the receiving part 140 and the head unit 50 increases, so that the recesses 32C of the thermal head 32 can fit with the protruding parts 52. Thus, the thermal head 32 can be easily attached to the head unit 50.

The present embodiment described above provides the printer 100 including: the thermal head 32 that performs printing on the print medium M; the head unit 50 to which the thermal head 32 is attached; the connector 55 (holding part) movable between the first position for holding the thermal head 32 at the attachment position of the head unit 50 and the second position for canceling the holding of the thermal head 32 to the attachment position; and the receiving parts 40 that receive the thermal head 32 when the connector 55 is at the second position.

With this configuration, when the thermal head 32 is exchanged, the operator moves the connector 55 to the second position, so that the holding of the thermal head 32 is released. Then, the thermal head 32 is received by the receiving parts 40, to be prevented from falling and hitting with other parts. Thus, the thermal head 32 needs not to be manually received by the operator, and thus can be easily exchanged.

The printer 100 includes the shielding member 61 movable between the shielding position for partially shielding the thermal head 32 and the opening position for opening the thermal head 32. The printer 100 includes the interlocking mechanisms 60 that move the connector 55 (holding part) to the first position when the shielding member 61 is at the shielding position and to the second position when the shielding member 61 is at the opening position.

With this configuration, the operator opens/closes the shielding member 61 after attaching the thermal head 32 to the head unit 50, to move the connector 55 to the first position or the second position to be connected to or released from the thermal head 32. Thus, the operator does not have to perform the manual operation in which the connector 55 is held and moved in a direction toward the first position or to the second position, whereby the exchanging operation can be easily performed.

The shielding member 61 is supported to be pivotable with respect to the head unit 50. The interlocking mechanisms 60 each include the gears 63 and 64 that convert a rotational motion of the shielding member 61 into a movement of the connector 55 toward and away from the thermal head 32.

With this configuration, when the shielding member 61 is pivoted by the operator to cover the thermal head 32, the interlocking mechanisms 60 cause the connector 55 to move, via the gears 63 and 64, to be connected to the thermal head 32.

The connector 55, connected to the thermal head 32, is provided as the holding part that holds the thermal head 32 at the attachment position to be attached to the head unit 50.

With this configuration, the connector 55 provides both a function of energizing the thermal head 32 and a function of holding the thermal head 32 at the attachment position, whereby the printer 100 can have a simplified configuration.

The receiving parts 40 each include the first contact part 41 that comes into contact with the lower end 32D of the thermal head 32 and the second contact part 42 that is bent from the first contact part and comes into contact with the front surface 32A of the thermal head 32. The thermal head 32 in the state of being received by the receiving parts 40 is inclined so that the upper end 32F of the thermal head 32 is separated from the head unit 50.

With this configuration, the thermal head 32 falling from the attachment position has the lower end 32D in contact with the first contact parts 41 and has the front surface 32A in contact with the second contact parts 42, to be surely received by the receiving parts 40. Furthermore, the thermal head 32 is inclined to have the upper end 32F separated from the head unit 50, so that the operator can easily perform the manual operation in which the thermal head 32 is held and removed from the head unit 50.

The two receiving parts 40 are arranged in the longitudinal direction of the thermal head 32 while being separated from each other.

With this configuration, the thermal head 32 engages with the two receiving parts 40 arranged in the longitudinal direction of the thermal head 32 while being separated from each other, to be surely received by the receiving parts 40.

The head unit 50 includes the protruding parts 52 (restriction part) that position the thermal head 50 at the attachment position to be attached to the head unit 50. The protruding parts 52 are inclined downward when the thermal head 32 is exchanged.

With this configuration, the thermal head 32 can be detached from the protruding parts 52 inclined by the gravity, by appropriately setting an angle of inclination of the X axis along which the protruding parts 52 extend with respect to the horizontal line L. Thus, the operator needs not to perform a manual operation in which the thermal head 32 is held and removed from the protruding parts 52, whereby the operation of removing the thermal head 32 can be easily performed.

While some embodiments of the present invention have been described, the above-described embodiments illustrate some examples to which the present invention is applicable and are not intended to limit the technical scope of the present invention to the specific configurations of the above-described embodiments.

The present application claims priority to Japanese Patent Application No. 2018-34817 filed on Feb. 28, 2018 to Japan Patent Office, the entire content of which is incorporated herein by reference.

The invention claimed is:

1. A printer comprising:

a thermal head configured to print on a print medium;

a head unit to which the thermal head is attached;

a holder movable between a first position for holding the thermal head at an attachment position of the head unit and a second position for canceling the holding of the thermal head at the attachment position; and a receiver configured to receive the thermal head below the attachment position when the thermal head is separated from the head unit in a state where the holder is at the second position.

2. The printer according to claim 1, wherein the receiver is provided in a direction in which the thermal head falls when the holder is at the second position.

3. The printer according to claim 2, further comprising a shielding member movable between a shielding position for partially shielding the thermal head and an opening position for opening the thermal head, and an interlocking mechanism configured to move the holder to the first position when the shielding member is at the shielding position and move the holder to the second position when the shielding member is at the opening position.

4. The printer according to claim 1, wherein the holder is a connector that is configured to be connected to the thermal head at the first position and configured to be disconnected from the thermal head at the second position.

5. The printer according to claim 1, wherein the receiver includes a first contact part configured to come into contact with a lower end of the thermal head and a second contact part configured to bend from the first contact part and come into contact with a front surface of the thermal head, and the thermal head in a state of being received by the receiver is inclined so that an upper end of the thermal head is separated from the head unit.

6. The printer according to claim 1, wherein two receivers are arranged in a longitudinal direction of the thermal head while being separated from each other.

7. A printer comprising:

a thermal head configured to print on a print medium;

a head unit to which the thermal head is attached;

a holder movable between a first position for holding the thermal head at an attachment position of the head unit and a second position for canceling the holding of the thermal head at the attachment position;

a receiver configured to receive the thermal head when the holder is at the second position; and a shielding member movable between a shielding position for partially shielding the thermal head and an opening position for opening the thermal head, and an interlocking mechanism configured to move the holder to the first position when the shielding member is at the shielding position and move the holder to the second position when the shielding member is at the opening position.

8. A printer comprising:

a thermal head configured to print on a print medium;

a head unit to which the thermal head is attached;

a holder movable between a first position for holding the thermal head at an attachment position of the head unit and a second position for canceling the holding of the thermal head at the attachment position; and a receiver configured to receive the thermal head when the holder is at the second position, wherein the receiver includes a first contact part configured to come into contact with a lower end of the thermal head and a second contact part configured to bend from the first contact part and come into contact with a front surface of the thermal head, and the thermal head in a state of being received by the receiver is inclined so that an upper end of the thermal head is separated from the head unit.

* * * * *